US006065802A

United States Patent [19]

Bue

[11] Patent Number: 6,065,802

[45] Date of Patent: May 23, 2000

[54] FOLDING TABLE AND SEATING APPARATUS

[75] Inventor: Richard C. Bue, Chaska, Minn.

[73] Assignee: Sico Incorporated, Minneapolis, Minn.

[21] Appl. No.: 09/057,281

[22] Filed: Apr. 8, 1998

[51] Int. Cl.[7] ..... A47B 39/00; A47B 83/02

[52] U.S. Cl. ..... 297/158.4; 297/159.1; 297/170; 297/174; 108/168; 108/172

[58] Field of Search ..... 297/158.4, 157.1, 297/159.1, 170, 174; 108/115, 168, 172

[56] References Cited

U.S. PATENT DOCUMENTS

| | | | |
|---|---|---|---|
| Re. 24,454 | 4/1958 | Wilson . | |
| D. 194,038 | 11/1962 | Preston . | |
| D. 211,886 | 8/1968 | Benjamin . | |
| D. 250,151 | 11/1978 | Pingel . | |
| D. 327,178 | 6/1992 | Ryaa . | |
| D. 369,913 | 5/1996 | Noll . | |
| 1,339,232 | 5/1920 | St. John et al. | 297/159.1 X |
| 2,702,585 | 2/1955 | Wilson . | |
| 2,717,631 | 9/1955 | Howe | 297/158.4 |
| 2,721,778 | 10/1955 | Wilson . | |
| 2,730,417 | 1/1956 | Mitchell . | |
| 2,739,860 | 3/1956 | Wilson . | |
| 2,771,937 | 11/1956 | Wilson . | |
| 2,969,245 | 1/1961 | Wilson . | |
| 3,028,197 | 4/1962 | Wilson . | |
| 3,055,705 | 9/1962 | Wilson . | |
| 3,075,809 | 1/1963 | Wilson | 297/158.4 |
| 3,099,480 | 7/1963 | Wilson . | |
| 3,099,481 | 7/1963 | Bue . | |
| 3,101,064 | 8/1963 | Kanzeldberger et al. | 108/168 |
| 3,109,678 | 11/1963 | Wilson . | |
| 3,212,463 | 10/1965 | Anderson et al. | 108/168 |
| 3,245,363 | 4/1966 | Amthor, Jr. et al. | 108/168 |
| 3,337,262 | 8/1967 | Katzfey et al. | 297/158.4 |
| 3,411,823 | 11/1968 | Bue . | |
| 3,477,760 | 11/1969 | Bue . | |
| 3,536,356 | 10/1970 | Wilson . | |
| 3,580,632 | 5/1971 | Seymour | 297/158.4 |
| 3,715,143 | 2/1973 | Gerken et al. | 297/158.4 |
| 4,052,100 | 10/1977 | Nikitits et al. | 297/158.4 |
| 4,070,057 | 1/1978 | Jones | 297/158.4 |
| 4,131,311 | 12/1978 | Nikitits | 297/158.4 |
| 4,133,271 | 1/1979 | Carlson . | |
| 4,249,773 | 2/1981 | Giambalvo | 297/158.4 |
| 4,596,196 | 6/1986 | Gunter et al. | 297/158.4 X |
| 4,653,804 | 3/1987 | Yoo et al. | 297/158.4 |
| 4,700,987 | 10/1987 | Sraka et al. | 297/158.4 |
| 4,826,244 | 5/1989 | Choi | 297/158.4 |
| 4,883,314 | 11/1989 | Sakong | 297/158.4 X |
| 4,932,333 | 6/1990 | Jensen et al. | 297/158.4 X |
| 5,029,938 | 7/1991 | Song | 297/158.4 |
| 5,683,135 | 11/1997 | Williams | 297/158.4 X |
| 5,794,540 | 8/1998 | Dombrowski et al. | 108/172 X |

*Primary Examiner*—Milton Nelson, Jr.
*Assistant Examiner*—Rodney B. White
*Attorney, Agent, or Firm*—Merchant & Gould P.C.

[57] ABSTRACT

A folding table with seating, the table having an oval shape and seating structure. The folding table includes a pair of semi-circular shaped table top sections folding along the straight edge of each section. A lock maintains the table in the unfolded position and is easily released by accessing an end handle that extends downward from the center axis near the edges of the table top sections. A framework extends downward and out to eight stools, four stools spaced apart around the curving periphery of each table top section. A leg extending below each stool to provide spaced apart supports around the entire table. The folding framework folds the tables top from a planar horizontal position to a vertical position wherein the bottoms of the table tops substantially oppose one another. The stools fold around the ends of the table top in the folded position so that the table requires much less floor pace than in the unfolded, use position. In the folded position, the table and seating structure is supported on four wheels so that it can be rolled to any desired location. A lock holds the table in a nearly fully folded position for an improved rolling position.

24 Claims, 8 Drawing Sheets

FOLDING TABLE AND SEATING APPARATUS

BACKGROUND

Technical Field

The present invention relates to a folding table and accompanying seat structures and more particularly to a non-rectangular table, folding between a use position and a storage position.

In large, multi-purpose rooms that are utilized at various times as dining rooms, meeting halls, dance areas and the like, it is often desirable that multi-purpose furniture be used. This furniture normally includes tables, chairs, benches and/or stools and the like, or table and seat combinations. Such furniture provides added utility if it is of the folding type, so as to require minimum storage space. Folding tables and accompanying stools or benches are well known and provide seating and table space that requires a relatively small amount of storage space. Such folding tables generally are rectangular, folding along a center line, and have benches or stools placed along both sides of the table, but no seats at the ends. Examples of folding tables are shown in U.S. Pat. Nos. 2,771,937 to Wilson, 3,075,809, to Wilson, and 3,099,480 to Wilson, all assigned to Sico, Inc., the assignee of the present invention. Although such tables are successful in providing folding furniture with seating along either side, still further improvements are possible.

For certain teaching, dining and other applications, especially with young children, it can be appreciated that it is preferable to have seating provided in a somewhat circular arrangement rather than a linear arrangement. Such an arrangement provides for balanced disbursement of the seated occupants and may be more conducive to providing access to the center of the table. Such an arrangement may have dimensions that also fit better into some areas and may provide for added seating in a given space. Although oval tables and folding tables are known, heretofore, combination table and stool units have not provided seating around a non-rectangular folding table that folds from a use position to a storage position.

For folding tables, safety is a concern during folding, to protect workers' hands and fingers from being pinched. In addition, there may be a nearly folded position that is more suitable for moving the structures.

It can be seen then that a new and improved folding table with seating is needed. An oval folding table and seating apparatus that also provides seating evenly distributed around the table would provide advantages which are unknown in the prior art. Moreover, an oval folding table that folds safely from a use position to a storage position requiring minimal floor space provides even further advantages. The present invention addresses these as well as other problems associated with folding table and seating structures.

SUMMARY OF THE INVENTION

The present invention is directed to a folding table with seating, and in particular, to an oval folding table and seating structure. The folding table includes a pair of, for example, semi-circular shaped table top sections folding along the straight edge of each section. A lock maintains the table in the unfolded position and is easily released by accessing an end handle that extends downward from the center axis near the edges of the table top sections. A framework extends downward and out to eight stools, four stools spaced apart around the curving periphery of each table top section. A wheel or a leg extends below each stool to provide spaced apart supports around the entire table. The framework extends from under each stool inward toward the table top to provide easy access for the persons to be seated at the stools without impeding their access or seated comfort.

The folding framework folds the table tops from a planar horizontal position to a vertical position wherein the bottoms of the table tops substantially oppose one another. The stools fold around the ends of the table top in the folded position so that the table requires much less floor space than in the unfolded, use position. In the folded position, the table and seating structure is supported on four wheels so that it can be rolled to any desired location. A lock holds the table in a nearly fully folded position for an improved rolling position.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference letters and numerals indicate corresponding structure throughout the several views.

DETAILED DESCRIPTION OF THE PREFERRED EMBODIMENT

Figure 1:
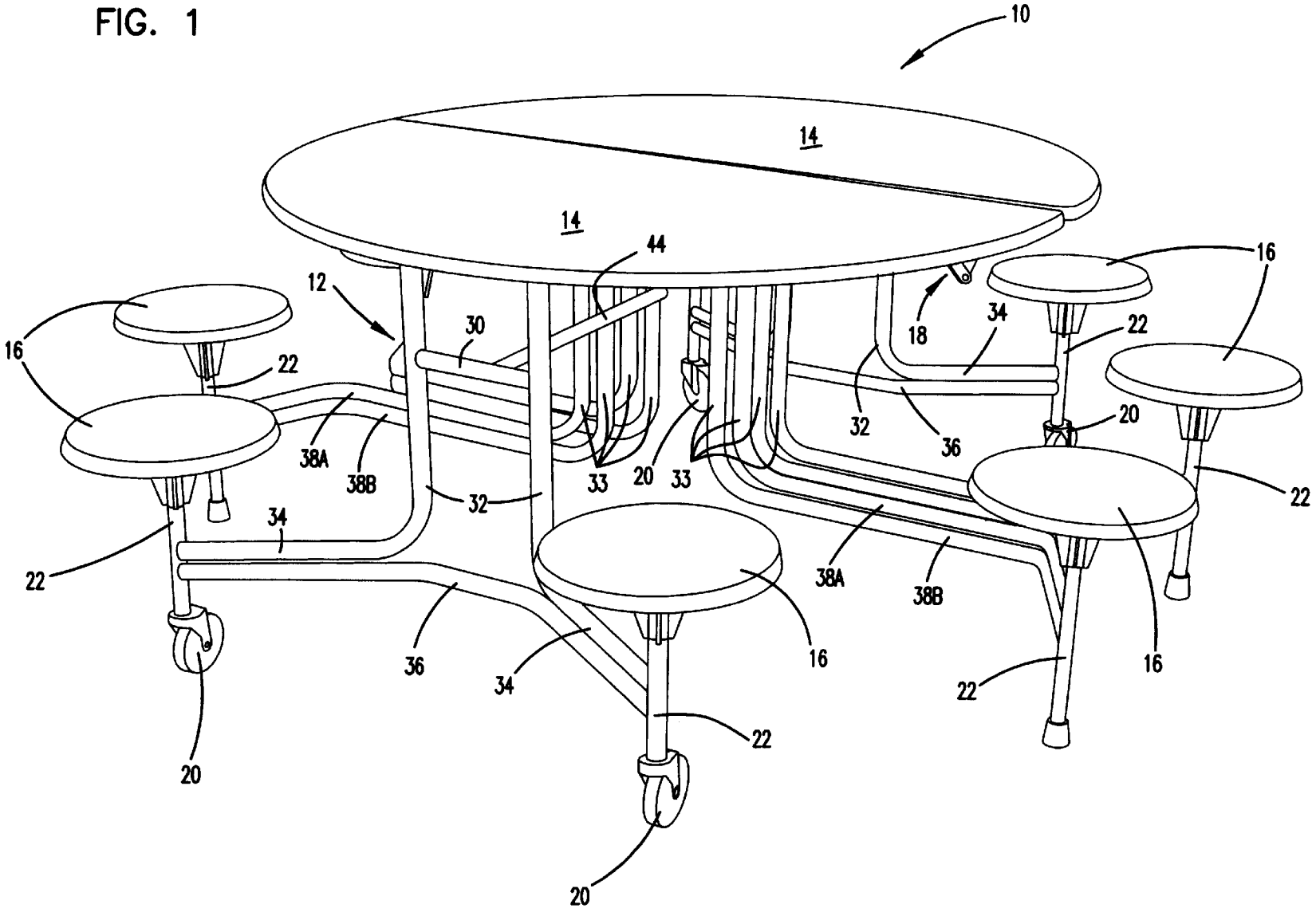
FIG. 1 shows a perspective view of a folding table and seating structure in an unfolded position according to the principles of the present invention.

Referring now to the drawings, and in particular FIG. 1, there is shown a table, generally designated 10. The table includes a pair of opposed table top sections 14 with a folding supporting frame 12. Eight stools 16 are spaced around the periphery of the table 10, four stools 16 about each table top section 14, and provide for seating proximate the edge of the table 10. The stools 16 are substantially evenly spaced apart so that eight users may sit at the table 10 without infringing upon one another's space.

Figure 2:
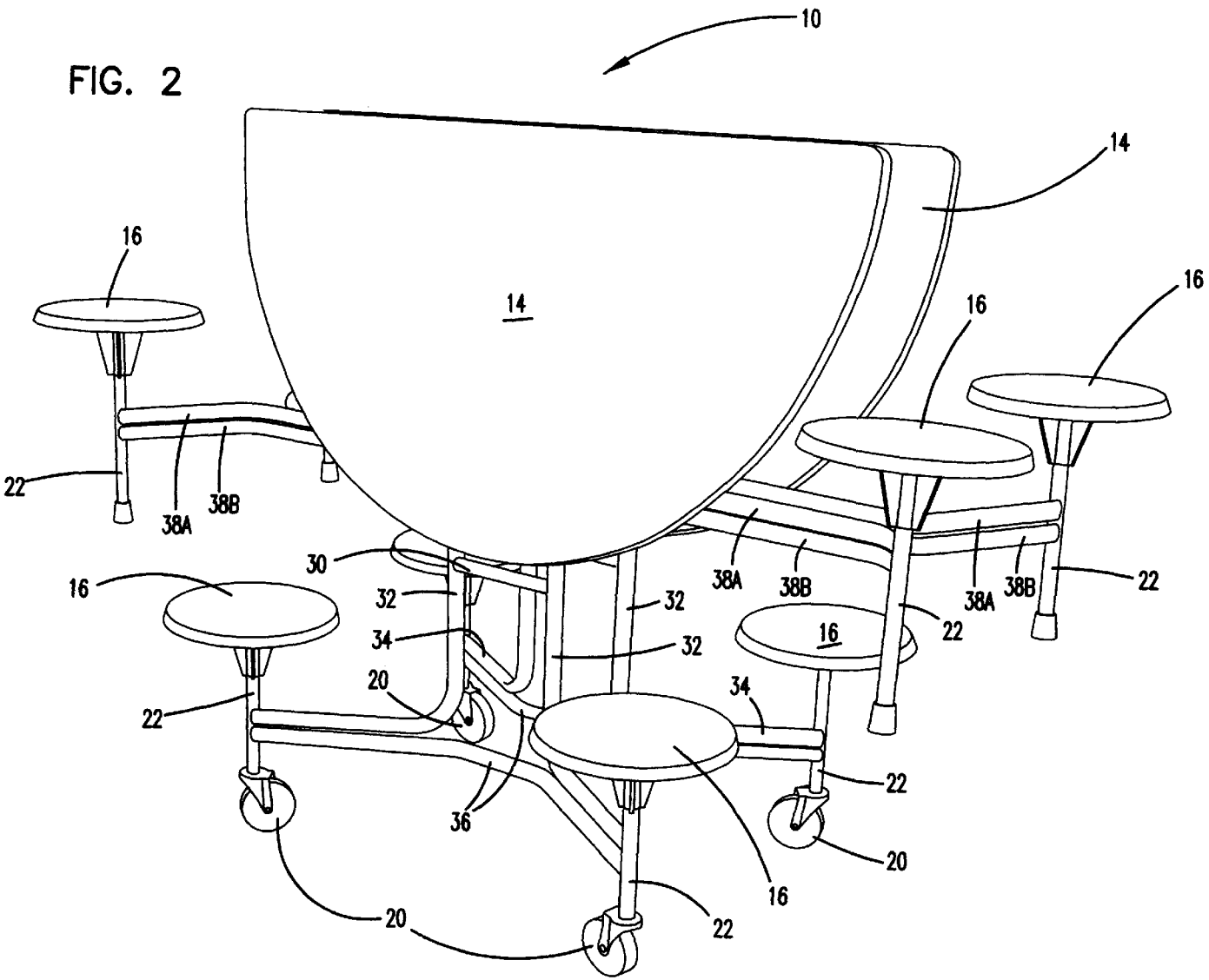
FIG. 2 shows a perspective view of the folding table shown in FIG. 1 in a folded storage position.
Figure 3:
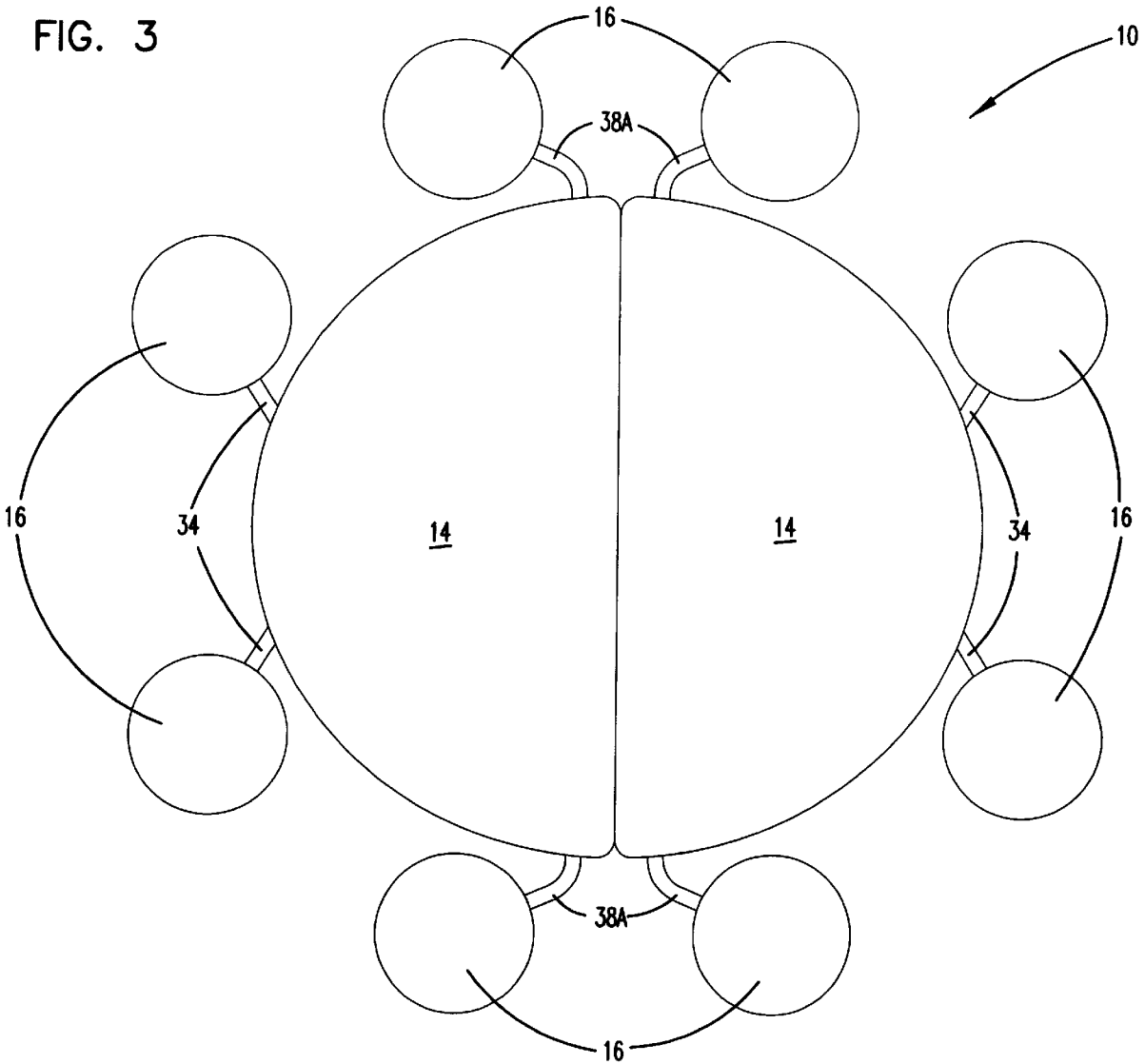
FIG. 3 shows a top plan view of the folding table shown in FIG. 1.

The table 10 includes a folding mechanism 18 that folds the table between the use position shown in FIG. 1, and the folded storage position, shown in FIG. 2. In the storage position, the stools 16 remain substantially horizontal while the table tops 14 fold to a vertically extending position with the bottom surfaces substantially facing one another. In the unfolded use position, the table 10 is supported on support legs 22 below four of the stools 16 and on casters or wheels 20 below the other four stools 16. In the folded storage position, the table 10 is supported on the four swiveling wheels 20, so that the table 10 may be rolled to any desired location. The folding mechanism 18 includes a latch to lock the table 10 in the unfolded use position. The latch has a lock member 50 that extends along the center line of the folding mechanism 18 and under the table tops 14 to near the edges so that it is hidden from above, yet is easily releasable by lifting a handle 52 from engaging a stop member, so that the table 10 may be folded.

Figure 4:
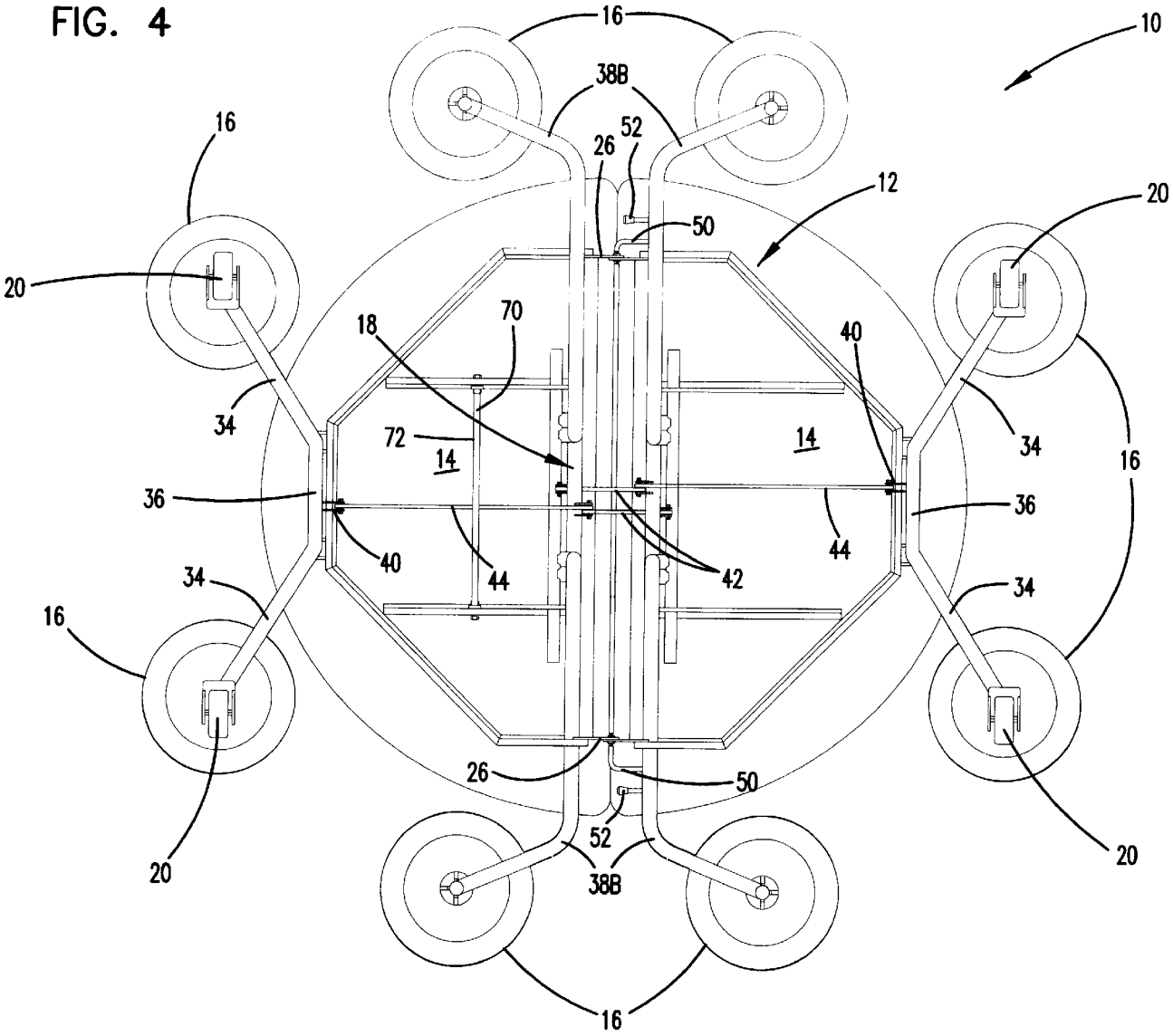
FIG. 4 shows a bottom plan view of the folding table shown in FIG. 1.
Figure 5:
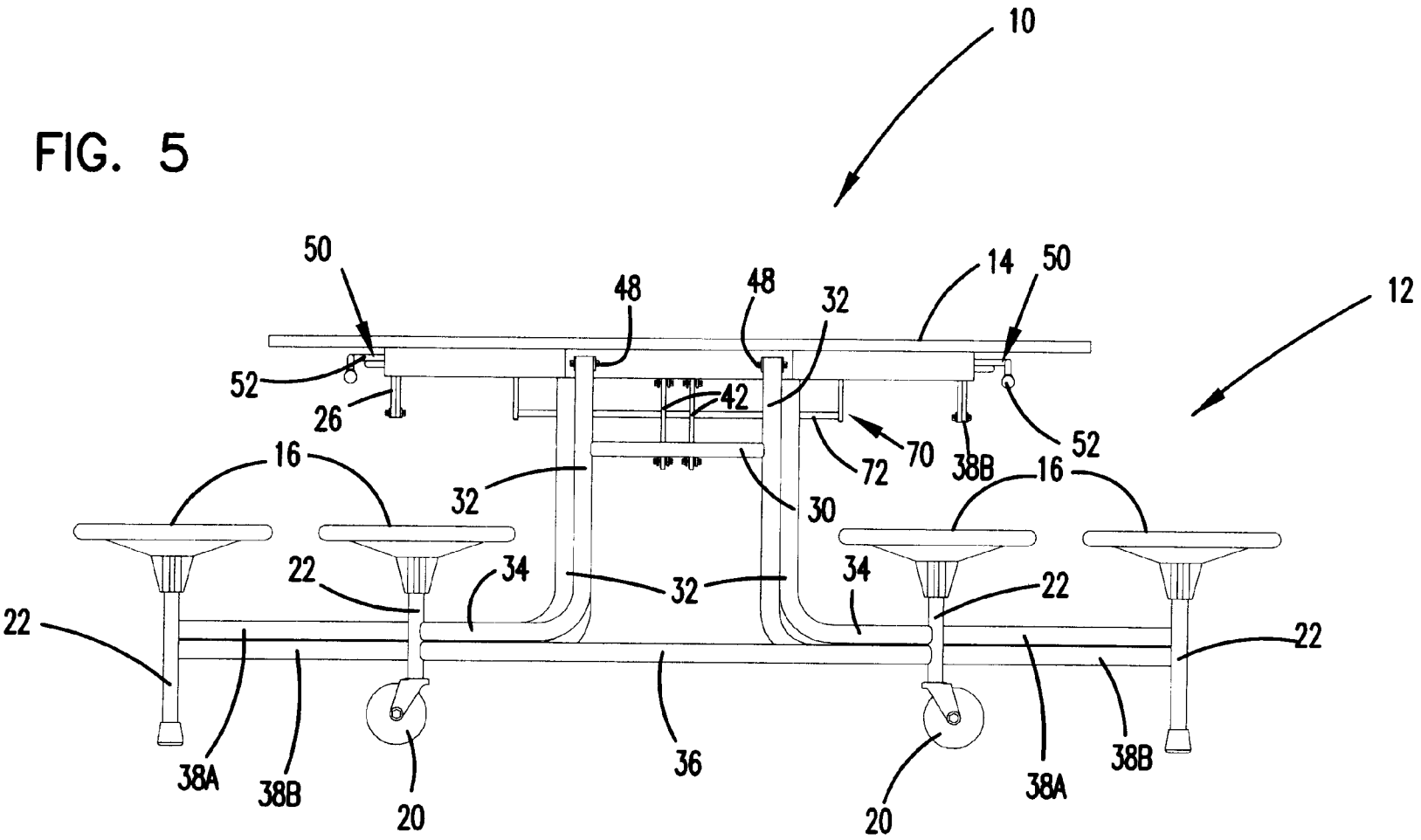
FIG. 5 shows a right side elevational view of the folding table shown in FIG. 1.

As shown most clearly in FIGS. 1, 4 and 5, the frame 12 includes risers 32 extending out from pivots 48 underneath the semi-circular table top members 14. The table tops 14 have arcing outer edges that form an oval, that is shown here as a circle. It is also envisioned that other non-rectangular shapes, such as octagons or other polygons could be used, preferably a configuration with adjacent stools 16 centered on the nearest straight section or arcing edge, and substantially evenly spaced about the periphery of the table 10. The risers 32 extend to horizontal sections 34 leading out to stool supports 22, while the stools 16 closest to the center folding line include a frame with risers 33 leading to double frame members 38A and 38B. In addition, lateral frame members 36 provide added support to the horizontal sections 34 for the end most stools 16. The double frame construction provides increased strength to the stools 16.

Figure 6:
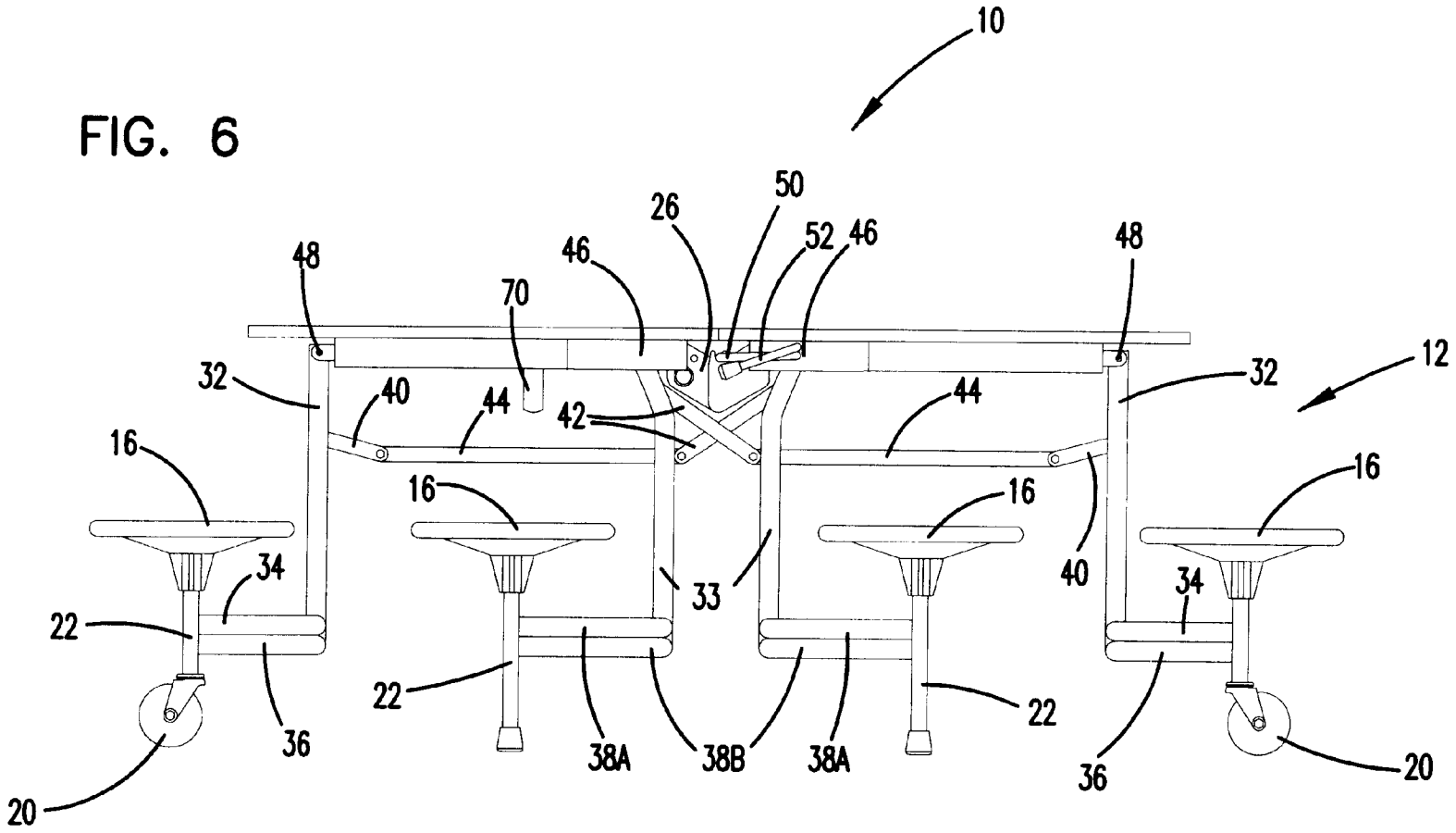
FIG. 6 shows an end elevational view of the round folding table shown in FIG. 1.

Referring to FIGS. 4 and 6, the folding mechanism 18 includes outer pivot members 26 along the folding center axis, connecting the straight edges of the two table top members 14. The folding mechanism 18 also includes first linkage members 42 and second linkage members 44 that attach to a pivot 46 on the frame as well as to the table top members 14 and pivot members 40 mounted to cross members 30 connecting the table risers 32 for the outer most stools.

The lock 50 extends along the center axis of the table top members 14 and is lifted up to release complementary cam-type pivot members 26 of the folding mechanism 18. The lock handles 52 extend downward under the table tops 14 and near the edges for easy access with a reduced risk of pinching fingers or hands, while being hidden from view from above. The center portion of the lock 50 is offset from the center edges of the table tops 14 to prevent the lock from being easily grabbed there by an operator. With the center portion of the lock 50 moved to a position wherein it cannot be gripped, the chances of an operator's hands being pinched between table tops 14 are reduced. When engaged in the unfolded position, the lock 50 prevents the table from folding. The lock 50 also stops the folding mechanism 18 just short of fully unfolding to provide added safety for preventing the edges of the table from pinching together until the lock 50 is actuated. Manually holding the lock 50 open and disengaged from pivot members 26 allows the table 10 to fully unfold. The folding mechanism 18 has torsion springs mounted to one or more of the cross members 30 to aid and control folding between the folded and unfolded positions. The torsion springs also aid to keep the table 10 from folding or unfolding unexpectedly and allows for actuating the lock 50. The folding linkage 18 provides for folding of the table between the folded and unfolded positions in a controlled manner. The folding mechanism 18 also maintains the stools 16 in a substantially horizontal position in both the folded and unfolded positions. It can be appreciated that in either position, the frame 12 provides a base of support so that the table 10 cannot easily tip in either the folded or unfolded position.

Figure 7:
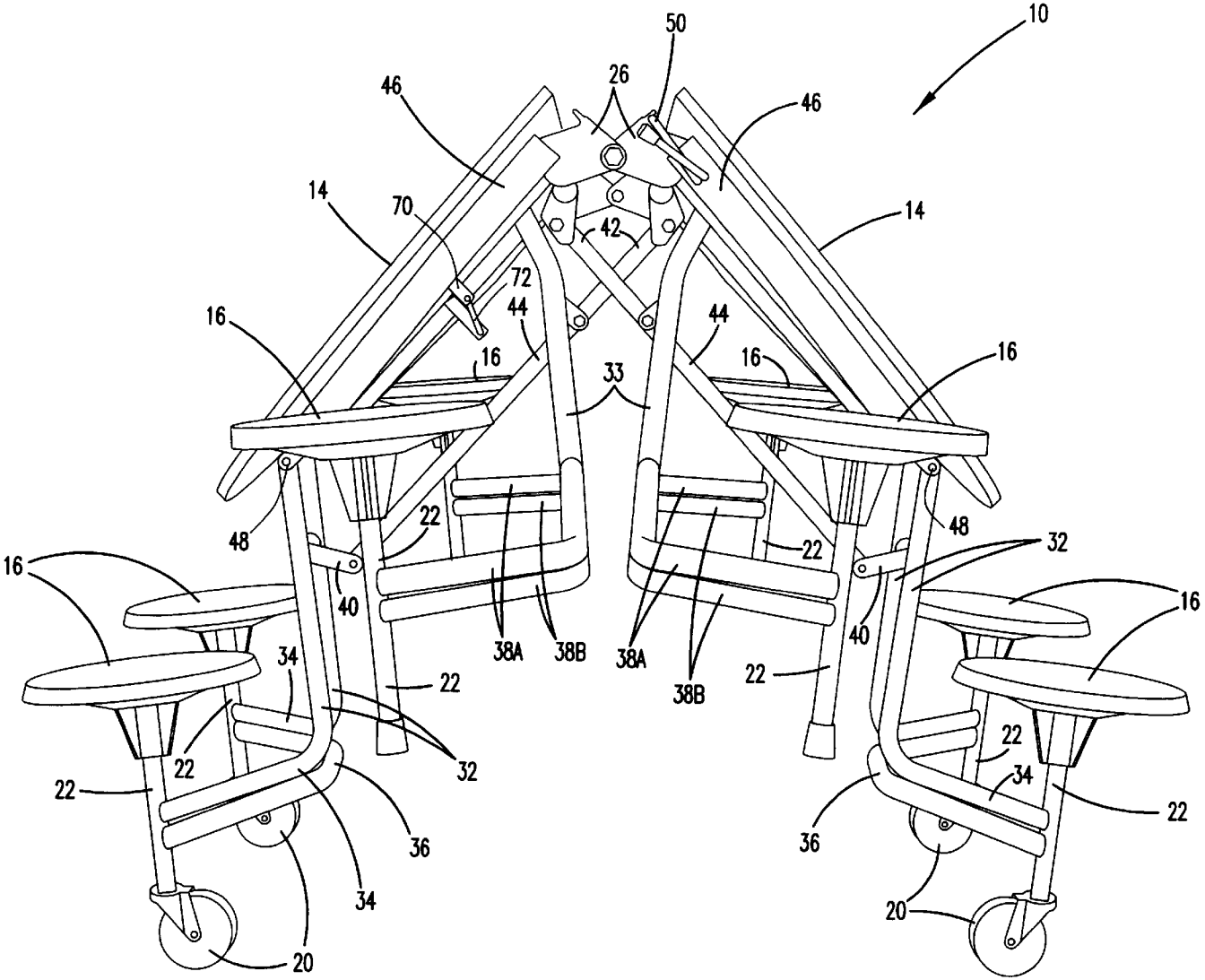
FIG. 7 shows an end perspective view of the round folding table shown in FIG. 1 in a partially folded position; and, FIG. 8 shows an end elevational view of the round folding table shown in FIG. 1 in a folded position with a linkage lock engaged.
Figure 8:
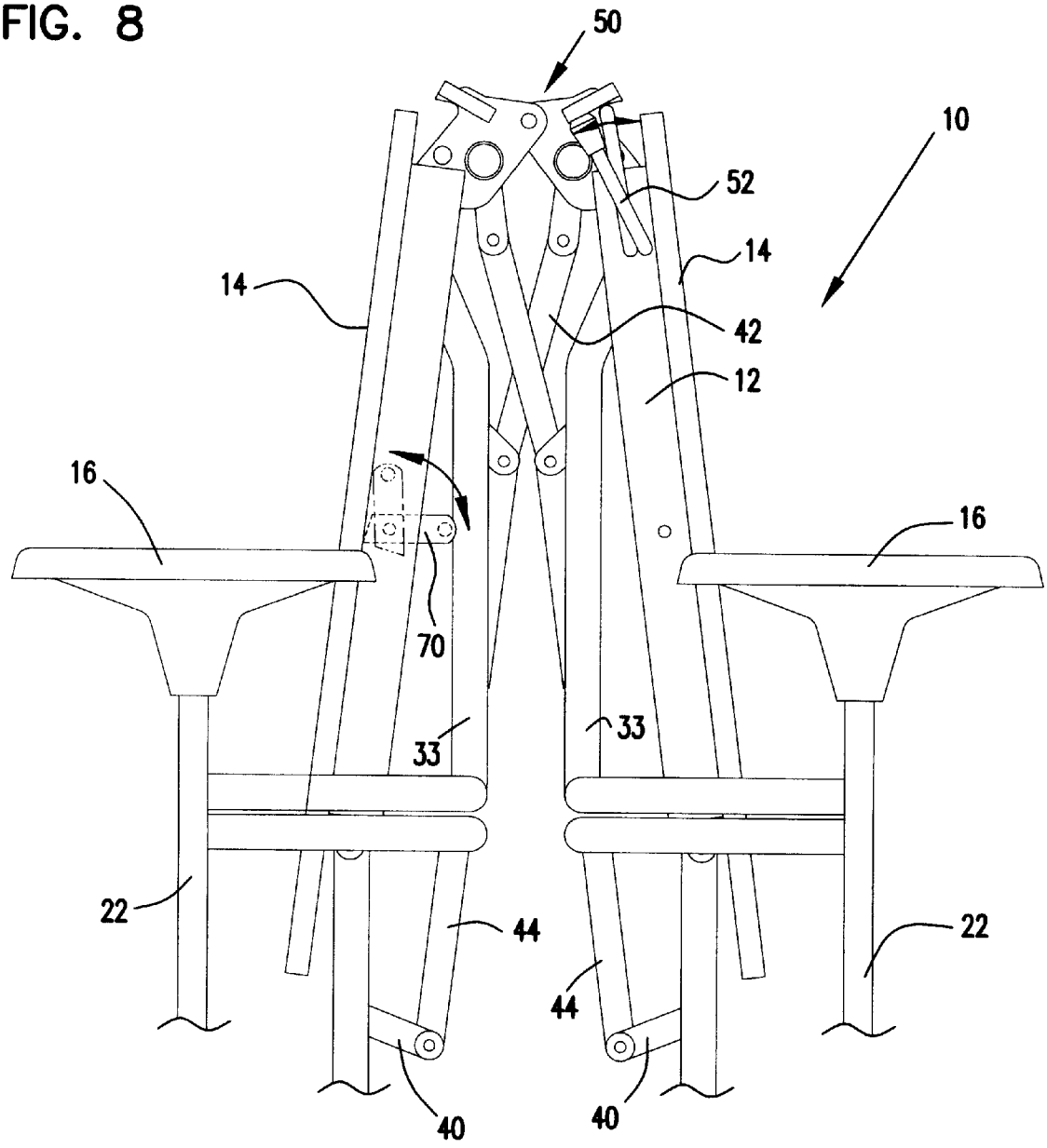

As shown in FIGS. 7 and 8, a stop 70 is utilized to aid in holding the table 10 in a wider folded travel position that provides greater stability during transport of the table 10. As, the table 10 is folded, it may be easier to push in a folded position wherein the table is supported solely on the wheels 20, but is not fully folded, as shown in FIG. 8. This maintains a slightly lower center of gravity, making movement easier. The stop 70 is pivotally mounted to the frame 12 at the underside of one of the table tops 14. The stop 70 includes a cross bar 72 engaging the risers 32 of the frame 12, as shown in FIG. 8. The stop 70 hangs by gravity, and it may be manually lifted up to clear the frame 12, as shown in phantom in FIG. 8, and allow for fully folding the table 10, as may be appropriate for storage in limited spaces, as shown in FIG. 2. The stop 70 automatically drops down again when the table 10 is unfolded.

The frame 12 provides for supporting each of the stools 16 while keeping the support members 22 attaching under the table tops out of the way of the users, even while seated. The frame 12 also provides easy access to the stools 16 for seating without undue restriction. With the design of the present invention, the horizontal portions of the frame extend inward from the stools 16 nearest the apex of the section as well as those stools 16 along the center folding axis. The outer most stools 16 at each side of the table top members 14 have supports that provide an opening therebetween for unimpeded easy entry and exit between the seated and unseated position. The space between the stools 16 is wide enough so that there is sufficient room for passage between the stools with no obstruction from the frame members. The present invention provides for substantially evenly spacing the stools 16 about the periphery of the table top members 14 so that there is sufficient use of space on the table top 14 at each seated position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A folding table, comprising:

a pair of table tops, each table top having a straight edge and an arcing edge defining a maximum distance from the straight edge wherein the straight edge and the arcing edge intersect and the table tops form an oval table surface;

a folding linkage folding the table tops about a centerline between a use position and a folded storage position;

a plurality of stools disposed about a periphery of the table, including at least two first stools spaced beyond the arcing edge of each table top further from the straight edge than the maximum distance from the straight edge and a second stool spaced laterally outward beyond an edge of the table tops where the straight edge and the arcing edge intersect;

a plurality of support legs, wherein each stool includes a support leg;

a frame connecting the support legs to the folding linkage.

2. A folding table according to claim 1, wherein the stools are evenly spaced about the periphery of the table.

3. A folding table according to claim 1, wherein the plurality of stools comprises eight stools that are supported in opposed pairs with openings free of support members formed between two pairs of stools at each of the table top members.

4. A folding table according to claim 1, wherein the stools have a substantially horizontal upper seating surface in the use position and storage position.

5. A folding table according to claim 1, wherein each of the stools includes a support extending substantially horizontally from a position under the table top obliquely to the table top arcing edge.

6. A folding table according to claim 1, wherein each of the table tops includes four stools spaced along the arcing edge, and wherein each of the stools has a stool support extending from under the table obliquely to the arcing edge such that a first adjacent pair of the four stools defines an unimpeded walking space therebetween and a second adjacent pair of the four stools defines an unimpeded walking space therebetween.

7. A folding table and seating apparatus, comprising:

two opposed table top members, each of the table top members having a straight edge and an arcing edge defining four equally spaced quadrants along the arcing edge, wherein the straight edges oppose one another;

a frame supporting each table top member;

a folding linkage folding the table top members between a use position wherein the table top members form a horizontally extending table top and a storage position wherein the table top members substantially face one another; and, four stools mounted to the frame of each table top member, wherein two first stools are spaced apart about an apex of the arcing edge of the associated table top member and two second stools are spaced apart about the apex of the arcing edge of the associated table top member laterally outward from the first stools so that each stool is placed in a different quadrant about the arcing edge.

8. A folding table and seating apparatus according to claim 7, wherein each stool includes a vertical member engaging the ground.

9. A folding table and seating apparatus according to claim 8, wherein each of the first stools include a caster mounted to the vertical member.

10. A folding table and seating apparatus according to claim 7, wherein each of the stools includes a support extending from the under the table obliquely to the table top member arcing edge.

11. A folding table and seating apparatus according to claim 7, wherein the stools have a substantially horizontal upper seating surface in the use position and storage position.

12. A folding table and seating apparatus according to claim 7, wherein each table top member includes four stools spaced along the arcing edge, and wherein each of the stools has a seat and a stool support spaced apart from the seat and extending from under the table obliquely to the arcing edge such that a first adjacent pair of the four stools defines an unimpeded walking space therebetween and a second adjacent pair of the four stools defines an unimpeded walking space therebetween.

13. A folding table and seating apparatus according to claim 7, further comprising a first lock mounted beneath one of the table tops and engaging the folding linkage for preventing folding motion and maintaining the table in an unfolded position.

14. A folding table according to claim 13, further comprising frame riser portions and a selectively engageable stop pivotally mounted to the frame at a first position for engaging one of the riser portions for preventing the table from fully folding to the storage position.

15. A folding table, comprising:

a pair of non-rectangular table tops having a straight edge and a nonlinear outer edge;

a folding linkage folding the table tops about a centerline along the straight edges between an unfolded use position and a folded storage position;

a plurality of stools disposed about a periphery of the outer edge of each of the table tops including a stool positioned outward from the centerline beyond the outer edge in the use position and the storage position;

a frame supporting the table tops and attached to the folding linkage, wherein the frame extends to each of the stools;

a plurality of legs, wherein each stool includes a leg mounted to the frame.

16. A folding table according to claim 15, wherein the first stools positioned outwardly beyond the outer edge are mounted on a caster engaging the ground in the use position and storage position, and wherein other of the plurality of stools are lifted from the ground in the storage position.

17. A folding table according to claim 15, wherein the stools are evenly spaced about the periphery of the table.

18. A folding table according to claim 15, wherein the plurality of stools comprises eight stools and wherein the stools are supported in opposed pairs with openings free of support members formed between two pairs of stools at each of the table top members.

19. A folding table according to claim 15, wherein the stools have a substantially horizontal upper seating surface in the use position and storage position.

20. A folding table according to claim 15, wherein each of the table tops has an arcing edge wherein each of the stools includes a support extending from under the table obliquely to the table top arcing edge.

21. A folding table according to claim 1, wherein each of the first stools includes a caster mounted on the associated support leg and wherein the table is supported only on casters in the storage position.

22. A folding table according to claim 1, wherein each table top includes at least two second stools.

23. A folding table and seating apparatus, comprising:

two opposed table top members, each of the table top members having a straight edge and an arcing edge, wherein the straight edges oppose one another;

a frame supporting each table top member;

a folding linkage folding the table top members between a use position wherein the table top members form a horizontally extending table top and a storage position wherein the table top members substantially face one another; and, four stools mounted to the frame of each table top member, wherein two first stools are spaced apart about an apex of the arcing edge of the associated table top member and spaced outward from the straight edge beyond the apex of the arcing edge, and two second stools are spaced apart about the apex of the arcing edge of the associated table top member laterally outward from the first stools and laterally outward beyond each end of the arcing edge.

24. A folding table, comprising:

a pair of table tops, each table top having a straight edge and an arcing edge, wherein the table tops form an oval table surface;

a frame;

a folding linkage mounted to the frame folding the table tops about a centerline between a use position wherein the table tops are substantially horizontal and a storage position wherein the table tops are substantially vertical;

a plurality of stools disposed about a periphery of the table including at least one first stool spaced outwardly from the centerline beyond the edge of the table in the use position and in the storage position and at least one stool spaced laterally outward parallel to the centerline beyond an end of the arcing edge;

a plurality of support legs connected to the frame, wherein each stool includes a support leg.

* * * * *